US005152064A

United States Patent [19]

Johnston

[11] Patent Number: 5,152,064

[45] Date of Patent: Oct. 6, 1992

[54] SHAVING METHOD AND APPARATUS

[76] Inventor: William M. Johnston, Woodinville-Duvall Rd. 19145-D Suite 132, Woodinville, Wash. 98072

[21] Appl. No.: 757,019

[22] Filed: Sep. 9, 1991

[51] Int. Cl.[5] ..... B26B 19/28

[52] U.S. Cl. ..... 30/45; 30/50; 132/200

[58] Field of Search ..... 30/32, 34.05, 41, 45, 30/50, 77; 132/200, 289, 292

[56] References Cited

U.S. PATENT DOCUMENTS 4,733,467 3/1988 Borenstein ..... 30/41

*Primary Examiner*—Douglas D. Watts

*Attorney, Agent, or Firm*—Robert W. Jenny

[57] ABSTRACT

The apparatus comprises a chilling implement and a shaving implement. The chilling implement comprises a body with a roller at each end and containing a supply of shaving gel which is dispensed onto one of the rollers. The shaving implement comprises a drive unit and a plurality of cutting edges arranged in a flat plane when at rest. The edges can be deflected out of the plane linearly and perpendicularly to the plane or rockably about axes parallel to the plane and perpendicular to the cutting edges. The apparatus is spring loaded to return the edges to the plane. In refined embodiments the assemblies holding the cutting edges are pivotally attached to allow each assembly to also rock on an axis parallel to the cutting edges and the cutting edge assemblies are springably interconnected so that the plane of the cutting edges can be flat or twisted in either direction about an axis parallel to the plane. The shaving implement also comprises a roller with its axis parallel to the at-rest cutting edges. The roller is positioned such that it contacts the skin ahead of the cutting edges and is spring loaded to deflect in an arc toward the cutting edges and their at-rest plane. At rest the roller surface contacting the skin is approximately ¼ inch out of the at-rest plane of the cutting edges. The cutting edges are oscillated by the drive unit, the direction of oscillation being linear in the direction perpendicular to the cutting edges and in their at-rest plane.

Before use, the chilling implement and the gel it contains are refrigerated to approximately 0° F. In use the gel coated roller is used to chill an area of skin and apply a thin coating of shaving gel before the area is shaved with the shaving implement. The second roller is used to chill without adding saving gel.

7 Claims, 4 Drawing Sheets

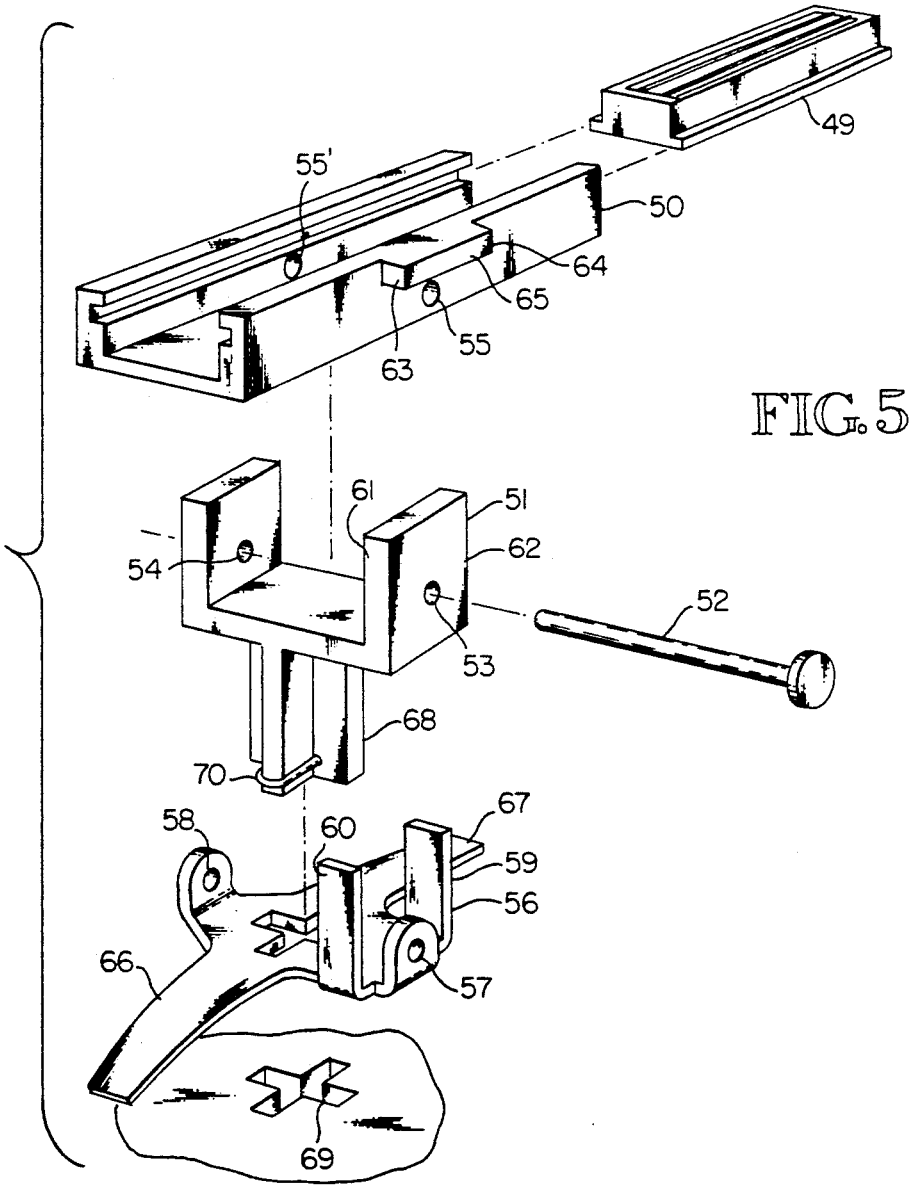
FIG. 5
FIG. 6
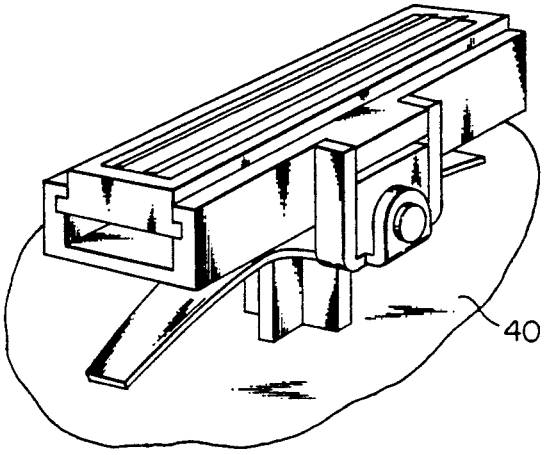

SHAVING METHOD AND APPARATUS

BACKGROUND OF THE INVENTION

1. Field

The subject invention is in the fields of skin conditioning methods and apparatus, shaving methods and apparatus and apparatus combining the two fields. Specifically, it is in the fields of combination of methods for skin conditioning and shaving and combination and individual apparatus for shaving purposes.

2. Prior Art

There is much prior art in these fields. Skin conditioning, for purposes of this disclosure, includes addition of apparatus to shavers to stretch or otherwise manipulate the skin to influence the effectiveness of the shaver as well as methods and apparatus for applying shaving creams and the like. The U.S. patents listed below provide a sample of the patented prior art.

| | |
|---|---|
| 1,270,635 | 3,339,278 |
| 1,882,370 | 3,756,105 |
| 2,472,385 | 3,768,485 |
| 2,749,613 | 4,813,136 |
| 2,787,621 | 4,819,330 |
| 2,929,374 | 4,845,846 |

In spite of the profusion and diversity of the prior art, there are many people who are not able to shave comfortably and to their satisfaction in terms of appearance, freedom from bristly texture (i.e. smoothness) and the duration of satisfactory appearance and smoothness if achieved. Such people often have a combination of soft, tender skin and strong or strong and curly hair growing from the tender skin. Accordingly, the primary objective of the subject invention is to provide method and apparatus which provides comforable, smooth, long lasting shaving results, particularly for people who have tender skin and tough or tough and curly hair and those who desire particularly smooth feeling skin after shaving for cosmetic purposes. Further objectives are that the apparatus use commercially available replaceable blades and that it provide optimum results without requiring more than average manual dexterity.

SUMMARY OF INVENTION

The subject invention is a shaving method and the apparatus for implementing the method. The method involves chilling the skin before passing the blade(s) over it. The chilling is done by applying a cold implement such as a roller to the skin, applying a thin layer of shaving cream, preferably with the implement, and chilling the shaving cream before it is applied. The shaving implement comprises one or more, three being preferred, commercially available safety razor cutting assemblies. The cutting assemblies are mounted so that, at rest, they are in tandem and parallel to each other with all the cutting edges in a flat plane. For purposes of this disclosure the term line of action is used. The line of action lies in the plane of the cutting edges, is perpendicular to those edges and bisects them lengthwise. The assemblies are spring mounted such that they can rock laterally with the cutting edge(s) remaining perpendicular to the line of action. They are also spring mounted such that they can move parallel to themselves out of the at rest plane in the direction normal to the plane and "away" from the surface being shaved.

The assemblies are mounted on a carriage and the carriage is activa such that the carriage and assemblies oscillate with the motion parallel to the line of action. The amplitude of the oscillation is in the range of one hundredth to one tenth of an inch with one twentieth of an inch (0.05 inches) preferred.

A roller is mounted perpendicular with its axis parallel to the at rest plane and perpendicular to the line of action. In its at rest position, the portion of the surface of the roller farthest from the at-rest plane is in the range of 0.1 to 0.3 of an inch away from the plane, with 0.25 of an inch preferred. The roller is positioned so that it contacts the surface being shaved before the cutting edge(s) do and it is spring mounted such that the contact area between it and the surface can deflect into the at rest plane and beyond. It is also mounted such that it can be moved out of the way to facilitate blade access to relatively inaccessible areas such as a person's upper lip.

All the spring mountings are such that the forces to cause each of the described deflections are essentially equal and in the range of 2 to 8 ounces of force with 5 ounces preferred.

The carriage, a guide for supporting the carriage and the activation apparatus are all mounted in or on a handle.

The roller of the chilling implement is pivoted in a handle. A container of shaving cream is also provided in the handle. The container is manually manipulable to cause dispensing of shaving cream onto the surface of the roller or to retract it to prevent dispensing gel until more is needed. There may be a second roller also mounted on the handle with shaving cream not dispensed onto it.

Before use the chilling implement, complete with the shaving cream supply, is refrigerated to the temperature in the freezing compartment of residential refrigerators, i.e. about 0° F.

The subject method comprises the steps of:

a) Refrigerating the chilling implement and shaving cream supply;
b) Using the chilling implement to chill a portion of the area to be shaved while applying shaving gel;
c) Shaving the portion of skin by rolling it ahead of a plurality of parallel linearly and rockably deflectable cutting edges while oscillating the cutting edges in the direction of cutting and
d) Repeating steps a through c until all the areas to be shaved are shaved.

The invention is described in more detail below with reference to the attached drawings.

BRIEF DESCRIPTION OF THE DRAWINGS

FIG. 5 is an exploded perspective view illustrating the mechanism for supporting the cutting edge assemblies on the carriage.

FIG. 6 is a perspective view of the mechanism of FIG. 5 assembled.

DETAILED DESCRIPTION OF THE INVENTION

Figure 1:
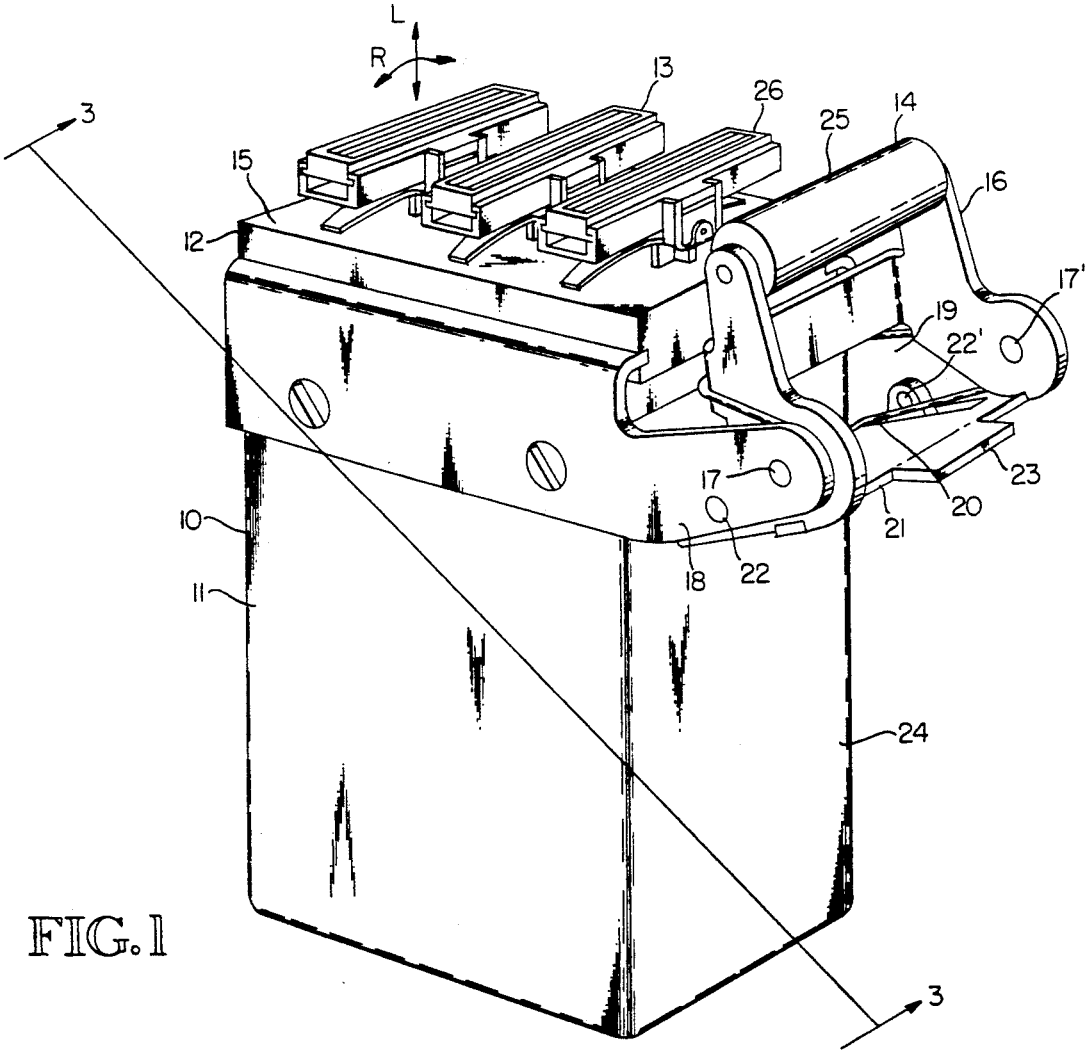
FIG. 1 is a perspective view of the shaver used in implementing the subject method.

The subject invention is a method for shaving and the apparatus for implementing the method. The method is implemented with a shaver and a chilling instrument. The shaver 10 is shown in perspective in FIG. 1 and comprises a power unit 11, a carriage 12, a plurality of cutting assemblies, of which assembly 13 is typical, and a roller 14. The cutting assemblies are slidably and rockably mounted on the carriage such that each assembly can deflect linearly in the direction perpendicular to the surface 15 of the carriage, as indicated by arrow L, and rock laterally on an axis which is centered over surface 15 and parallel to its longitudinal axis. The rocking action is indicated by arrow R.

Roller 14 is pivotally mounted to arm 16 which in turn is pivoted at 17 and 17' to brackets 18 and 19. Spring 20 exerts a force tending to swing arm 16 in the direction indicated by arrow S, carrying the roller with it. The swinging is limited by latch 21 pivoted at 22 and 22' in brackets 18 and 19. Depressing tab 23 on the latch disengages the latch from arm 16 and allows the roller to swing down roughly parallel to side 24 of unit 11, allowing the cutting assemblies to be moved into positions not possible with the roller in its latched position.

The forces required to deflect the cutting assemblies linearly and rotably and to deflect the roller toward the cutting assemblies are all essentially equal and in the order of a few ounces. In its latched position the portion of the surface of the roller 25 farthest from surface 15 is in the range of $\frac{1}{8}$ to $\frac{3}{8}$ of an inch above the plane of the blades, blade 26 being typical, of the cutting assemblies with $\frac{1}{4}$ inch preferred.

Figure 2:
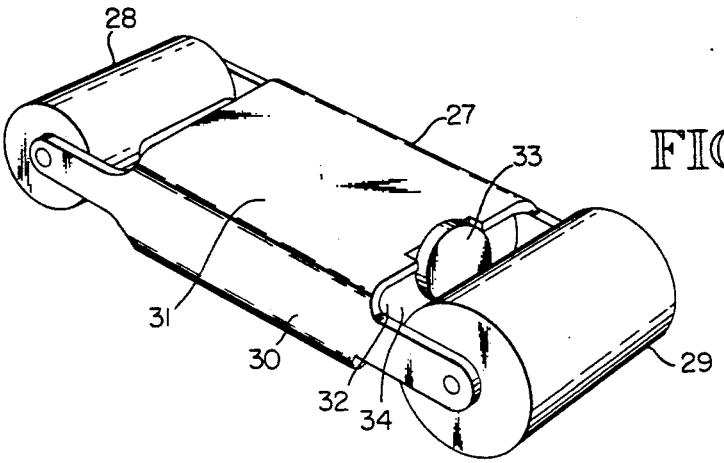
FIG. 2 is a perspective view of the chilling implement also used in implementing the subject method.

FIG. 2 illustrates the chilling instrument 27 used in implementing the subject method. Rollers 28 and 29 are rotably mounted in frame 30. Center portion 31 is a housing for a container 32 of shaving cream or gel, termed gel for purposes of this disclosure. The gel container is replaceable by removing roller 29 to allow the container to be removed and another inserted in its place. Knob 33 on end 34 of the container is operated to extrude the gel onto roller 28. The roller width is approximately equal to but less than the width of the bar of gel in commercially available shaving gel dispensers. Between uses of the apparatus it is stored in a freezing compartment so that the rollers and shaving gel are at a temperature in the range of −10° F. to +10° F., with 0° F. preferred, when the implement is to be used. Function and use of this implement are explained in more detail below.

Figure 3:
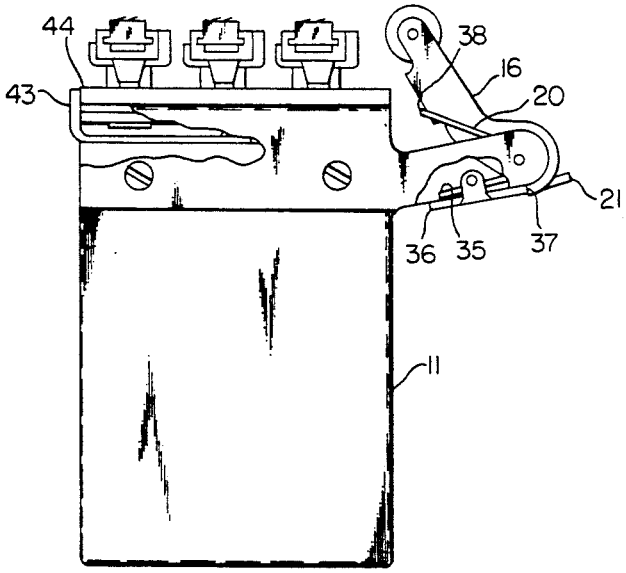
FIG. 3 is a sectional view taken at 3—3 in FIG. 1.

FIG. 3 is a sectional view taken at 3—3 in FIG. 1 and illustrates the relative sizes, shapes and orientation of the power unit, carriage, cutting assemblies roller and roller support elements. It is to be noted that end 35 of spring 20 contacts end 36 of latch 21 to hold it in engagement with shoulder(s) 37 on arm 16. End 38 of spring 20 engages arm 16 to tend to hold the roller in the position shown.

Figure 4:
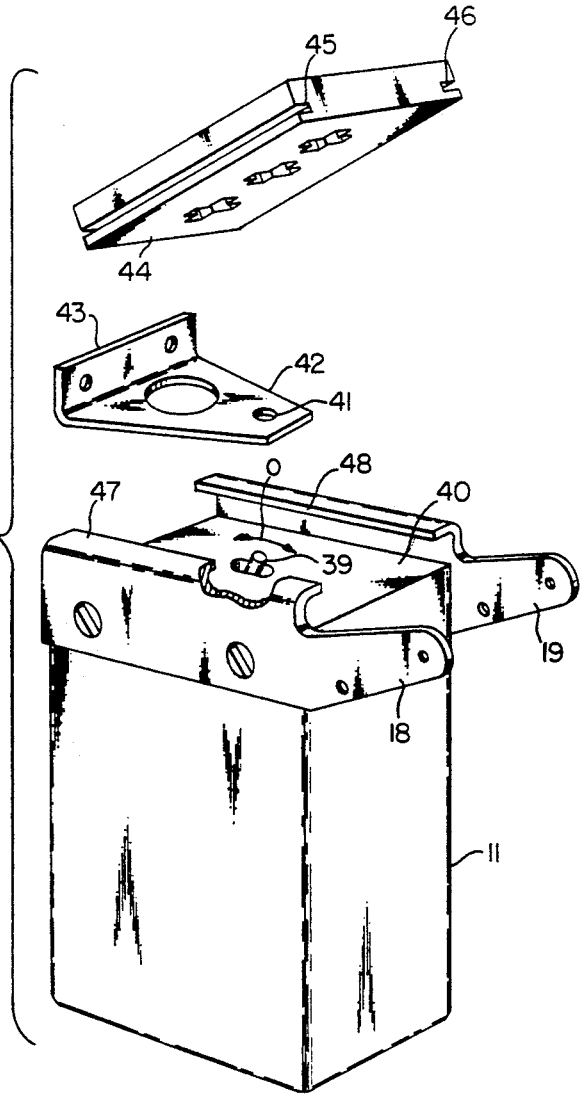
FIG. 4 is an exploded perspective view illustrating the drive mechanism for the carriage.

FIG. 4 illustrates the mechanism by which the carriage (and the apparatus mounted on it) are activated by the power unit 11. Stub shaft 39 extends from end 40 of the unit and oscillates augularly in the directions shown by arrow O. Hole 41 in link 42 engages the stub shaft and end 43 of the link is attached to end 44 of the carriage 12 to cause the carriage to oscillate with its line of action parallel to the longitudinal axis of the carriage. Grooves 45 and 46 in the carriage engage flanges 47 and 48 respectively of brackets 18 and 19 which are attached to the drive unit.

FIG. 5 is an exploded view of a cutting assembly and the mechanism for mounting it in the carriage. Razor blade assembly 49 is insertable into blade assembly holder 50. The holder is pivoted to bracket 51 by pin 52 engaging holes 53 and 54 in the bracket and 55 and 55' in the holder. Pin 52 also holds spring 56 in place on bracket 51 by engaging holes 57 and 58 on the spring and holes 53 and 54. Arms 59 and 60 of the spring rest against surfaces 61 and 62 on the bracket and engage ends 63 and 64 respectively of stop 65 on the holder. Rocking of the holder relative to the bracket is resisted by arms 59 and 60. Arms 66 and 67 contact surface 15 of the carriage and urge the cutting assembly away from the carriage. Cruciform shaped stub 68 of the bracket fits closely but freely into hole 69 in the carriage and, once inserted in place, is held in place by clip 70, shown engaged in this view.

FIG. 6 illustrates a cutting assembly installed in the carriage.

To shave with the subject chilling implement and shaver an area to be shaved is chilled and coated with a thin layer of gel by rolling roller 28 over the area. The shaver is then used with the roller and cutting edges advancing across the area to be shaved. The cutting edges oscillate in the direction parallel to the line of action and perpendicular to the cutting edge(s).

To provide further chilling without adding shaving gel, roller 29 is used. The combination of the chilling, the linear and rocking freedom of the cutting assemblies, the plurality of the cutting assemblies, the activation of the cutting assemblies, the light rolling of the skin area in advance of the cutting assemblies and the use of minimal amounts of gel provide an excellent shave, even of tough hair in tender skin.

The shaving method implemented by the described apparatus thus comprises the steps of:

a) Refrigerating the chilling implement and shaving gel supply;
b) Using the chilling implement to chill a portion of the skin to be shaved while applying chilled shaving gel;
c) Shaving the portion of skin by rolling it ahead of a plurality of parallel, linearly and rockably deflectable cutting edges with the cutting edges oscillating in the direction of cutting and
d) repeating steps a–c until shaving of all portions of the skin to be shaved is completed.

Figure 7:
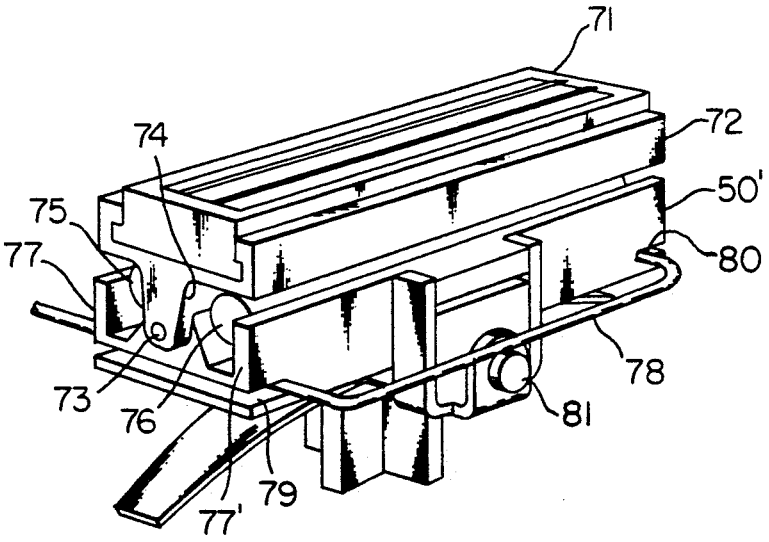
FIG. 7 illustrates refinements of the mounting of the cutting edge assemblies.

FIG. 7 illustrates refinements of the mounting of the cutting edge assemblies, showing the mounting of one for description purposes. In this embodiment the razor blade assembly 71 is inserted in holder 72 which is pivoted at 73 to modified holder 50'. Rib 74 extends end to end and elastomeric elements 75 and 76 support it between ribs 77 and 77' on holder 50'. In this embodiment the blade assembly is resiliently supported and is free to rock, within the limits of restoring forces provided by elements 75 and 76, about axis 73 which is parallel to the cutting edges. A second refinement is that holders 50' are interconnected by a spring wire loop 77 installed in grooves 78 and 79 and corresponding grooves in the other holders. The effect of this resilient loop is to tend to transmit deflection of one holder to adjoining holders keeping them essentially in a plane while the plane is distorted from its at rest flat conformation by deflection of one or more of the assemblies. For example, at rest all the cutting edges lie in a flat plane. However, deflection of one holder 50' about pivot 80 is not independent, but instead, causes adjoining holders to deflect with the one deflected holder, although in lesser amounts. In effect, deflecting the end holder in the array of holders will twist the plane of alignment of the cutting edges. These refinements have been found to enhance the effectiveness of the apparatus even though effectiveness without them is entirely acceptable.

Applicant acknowledges that descriptions of the subject method and apparatus can not show that the method and apparatus meet the primary objective of the invention. Nevertheless, the invention is the result of five years of development and testing and the tests clearly demonstrate the desired results. It is necessary for people to use it to become convinced of its effectiveness because it is a radical departure from conventional shaving techniques; however, every person who tries out the method and apparatus becomes convinced that they provide a closer shave than any other known method and apparatus. The blades used are commercially available. The size and weight of the shaving apparatus are commensurate with those of commercially available electric shavers so that manual dexterity required in using the subject apparatus is similar to that required with electric shavers.

It is considered to be understood that while currently preferred embodiments of the apparatus are described herein, other embodiments and modifications of those described are possible within the scope of the invention which is limited only by the attached claims.

I claim:

1. A method for shaving an area of skin, said method comprising the steps of:

a) chilling said area while applying chilled shaving gel, b) shaving said area by rolling it ahead of a plurality of parallel, linearly and rockably deflectable cutting edges with said edges oscillating in the direction of cutting.

2. Apparatus for shaving an area of skin, said shaving apparatus comprising:

a drive unit, a plurality of cutting assemblies, each of said assemblies having at least one cutting edge, means for mounting said cutting assemblies on said drive unit such that:

a) said assemblies have at-rest positions with said cutting edges parallel to each other in a flat plane and are deflectable linearly out of said plane in a direction normal to said plane and rockably deflectable about axes parallel to said plane and perpendicular to said cutting edges, such that the portion of said edge farthest out of said plane is out of said plane a distance in the range of $\frac{1}{8}$ of an inch to $\frac{3}{8}$ of an inch with $\frac{1}{4}$ of an inch preferred, said assemblies being spring loaded to return to said at-rest positions, b) said cutting assemblies are moveable in unison in a direction parallel to said plane and perpendicular to said cutting edges;

means for connecting said cutting assemblies to said drive unit such that said assemblies oscillate in a direction parallel to said plane and perpendicular to said cutting edges.

3. The apparatus of claim 2 further comprising a roller having a surface and an axis and means for mounting said roller on said shaving implement such that:

a) said axis is parallel to said cutting edges, b) said roller is deflectable toward said cutting edges and said plane, c) said roller has an at-rest position such that the portion of said surface farthest out of said plane is out of said plane distance in the range of $\frac{1}{8}$ of an inch to $\frac{3}{8}$ of an inch.

4. The apparatus of claim 3 in which said means for mounting said roller comprises means for allowing said roller to be moved clear of said plane.

5. The apparatus of claim 4 in which said means for mounting said cutting assemblies further comprises:

means such that said assemblies are each resiliently pivoted on an axis parallel to said at least one cutting edge, said axis being between said at least one cutting edge and said drive unit.

6. The apparatus of claim 3 in which said means for mounting said cutting assemblies further comprises:

means such that said cutting assemblies are restrained to remain in said plane when said plane is distorted by deflection of one or more of said cutting assemblies.

7. The apparatus of claim 5 in which said means for mounting said cutting assemblies further comprises:

means such that said cutting assemblies are restrained to remain in said plane when said plane is distorted by deflection of one or more of said cutting assemblies.

* * * * *